US005720549A

United States Patent [19]

Lavy

[11] Patent Number: 5,720,549

[45] Date of Patent: Feb. 24, 1998

[54] LAMP HEAD INCORPORATED WITH ANTI-COMBUSTION ARRANGEMENT

[76] Inventor: Danny Lavy, 225 Chabanel Street W #500, Montreal, PQ, Canada, H2N 2C9

[21] Appl. No.: 756,907

[22] Filed: Nov. 26, 1996

[51] Int. Cl.[6] ..... F21V 17/00

[52] U.S. Cl. ..... 362/378; 362/376; 362/218; 362/223; 362/307; 362/264; 362/343; 362/414

[58] Field of Search ..... 362/378, 218, 362/223, 263, 264, 307, 294, 343, 344, 345, 350, 376, 410, 414, 431, 293

[56] References Cited

U.S. PATENT DOCUMENTS 5,221,141 6/1993 Swanson ..... 362/250
5,519,594 5/1996 Wu ..... 362/223

*Primary Examiner*—Stephen F. Husar
*Attorney, Agent, or Firm*—Raymond Y. Chan; David & Raymond

[57] ABSTRACT

A lamp head incorporated with an anti-combustion arrangement, which includes an upwardly directed pan and a reflector member disposed internally of the pan. The reflector member has a planar lip for supporting a reflecting disc and a holding means for electrically receiving a halogen light source. The reflecting disc has an inner concave reflecting surface positioned below the halogen light source. A shielding lens is mounted on the planar lip for closely covering the halogen light source, wherein a high temperature burning zone is formed above the concave reflecting surface and around the halogen light source. The anti-combustion arrangement includes a transparent protective shelter and a supporting means. The protective shelter has a size adapted to entirely cover the halogen light source, the supporting means being disposed on the reflector member for supporting the protective shelter at a predetermined height from the planar lip and right above the halogen light source to cover the high temperature burning zone and to define an air ventilation clearance between the protective shelter and the halogen light source.

20 Claims, 8 Drawing Sheets

LAMP HEAD INCORPORATED WITH ANTI-COMBUSTION ARRANGEMENT

BACKGROUND OF THE PRESENT INVENTION

The present invention relates to a lamp head of a stand-alone electric lamp, and more particularly to a lamp head incorporated with an anti-combustion arrangement for protecting the halogen bulb mounted thereon from any combustible objects or materials that could accidentally be put or flown on top of the halogen bulb. The anti-combustion arrangement can also allow air to circulate above the halogen bulb so as to avoid heat accumulating and building up above the halogen bulb.

According to the statistic concerning burned down homes and offices every year, the high rating brings us a shock. Of course the occurrences of these accidents happened in many ways, but our local fire departments are trying their best every year to advertise all types of fire hazards and encouraging the local communities just to narrow down the chances of these accidents occurring in the future. Helpful organizations are formed every year just to help the unfortunates by fund raising, donations and etc.

As our technology grew over the years, them is a high incline in household electronic products being mass produced every year. Even though regulation of testing new product's safety is performed by our government, through time we find that it is very difficult to maintain and ensure the safety of the new tested products due to all the new unfamiliar discoveries. Many of the occurred fire accidents are cause by electronic products that are standard household needs such as our lighting equipment at home.

Today, there are a massive number of stand-alone floor or table electric lamps being manufactured and distributed through our market. Through a period of time we discover the danger that the stand-alone electric lamps had brought us. For example, a standard floor lamp stands rigidly rising up vertically ending above and over our head level. The floor lamp has a general area lighting lamp head which includes an upwardly directed dome, bowl or pan. A reflector member is disposed internally of the pan, which has a concave reflecting surface supported by a planar lip. The planar lip includes a holding means for receiving a high voltage halogen bulb, which is facing up toward the ceiling of our home, and also for supporting a protective shielding glass which is utilized to protect the halogen light from accidentally damage.

Sure, the standing floor lamp has a height that our children cannot reach, but most of the accidents were not caused by our young ones. The accidents usually happen when falling insects, spider webs and any other combustible matters reach within a high temperature burning zone around the halogen bulb. We all know that light attracts all types of insects. Once such combustible materials are put or flown to the halogen bulb and/or the concave reflecting surface, the accumulated heat generated by the halogen bulb around such high temperature burning zone may cause combustion of those combustible materials that, it could bum out the bulb or even the electric wires connected therewith and cause an hazardous fire.

The creation of the stand-alone floor or table lamps are one of the greatest invention, but we need to improve the unsafe part of the creation by not allowing the intrusion of any type of combustible matters into the high temperature burning zone of our lamp to bring a safer home and office to our communities. In fact, the best way to solve a problem is to prevent one.

SUMMARY OF THE INVENTION

It is an object of the present invention to provide a lamp head incorporated with an anti-combustion arrangement which can allow air circulation and ventilation within the high temperature burning zone of the lamp head and thus the heat generated therearound is reduced to a safe condition.

It is another object of the present invention to provide a lamp head incorporated with an anti-combustion arrangement which can prevent falling insects or any other combustible objects or materials to drop into the high temperature burning zone of the lamp head.

It is another object of the present invention to provide a lamp head incorporated with an anti-combustion arrangement which can provide colored lighting with the regular halogen bulb.

Accordingly, the present invention provides a lamp head incorporated with an anti-combustion arrangement that can highly increase the safety regulation in homes and office buildings. The lamp head comprises an upwardly directed pan, a reflector member disposed internally of the pan having a planar lip and a reflecting concave disc supported by the planar lip. The planar lip includes a holding means for receiving a high voltage halogen light source, which is facing upward, and also for supporting a shielding glass adapted to closely cover the halogen light source. The anti-combustion arrangement comprises a transparent protective shelter having a size at least equal to the diameter of the reflecting concave disc and a supporting means for supporting the protective shelter above the halogen light source for a predetermined height. The supporting means comprises at least a supporter having a base member adapted to firmly secure to the reflector member and an upper holder for rigidly and firmly hold the protective shelter right above the reflecting concave disc, the halogen light source and the shielding glass so as to entirely cover a high temperature burning zone which is an area zone above the reflecting concave disc of the reflector member and around the halogen light source. Furthermore, an air ventilation clearance is defined between the protective shelter and the halogen light source shielded with the shielding glass. The temperature within the high temperature burning zone is decreased by spreading the heat wave and providing air ventilation and circulation through the air ventilation clearance. Besides, the protective shelter can prohibit the intrusion of any combustible matters from entering the high temperature burning zone of the lamp head.

According to the present invention, the protective shelter can be made of a thickened planar glass, a thickened curved (concave or convex) glass or a colored glass.

DETAILED DESCRIPTION OF THE PREFERRED EMBODIMENT

Figure 1:
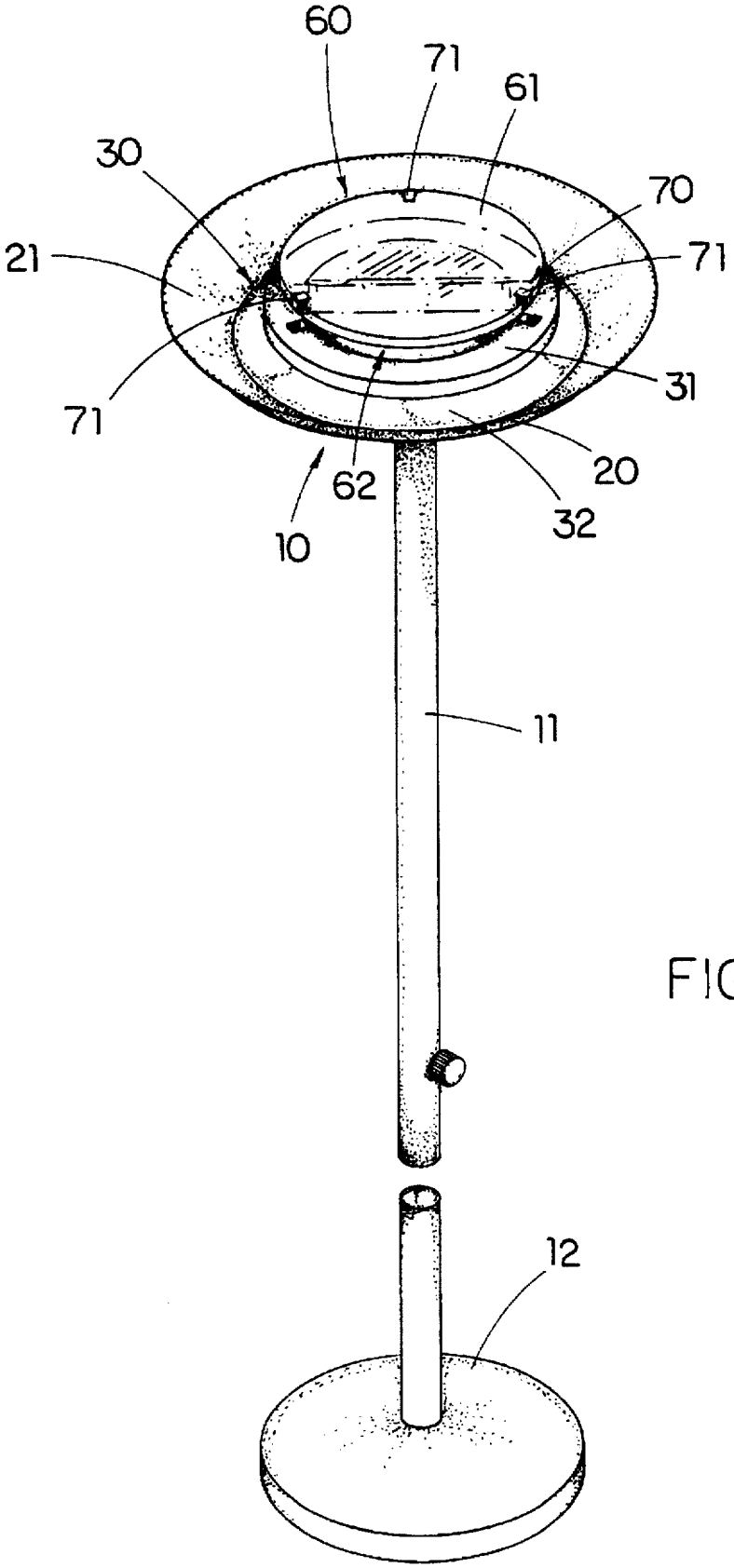
FIG. 1 is a perspective view of a lamp head incorporated with an anti-combustion arrangement according to a first preferred embodiment of the present invention.
Figure 2:
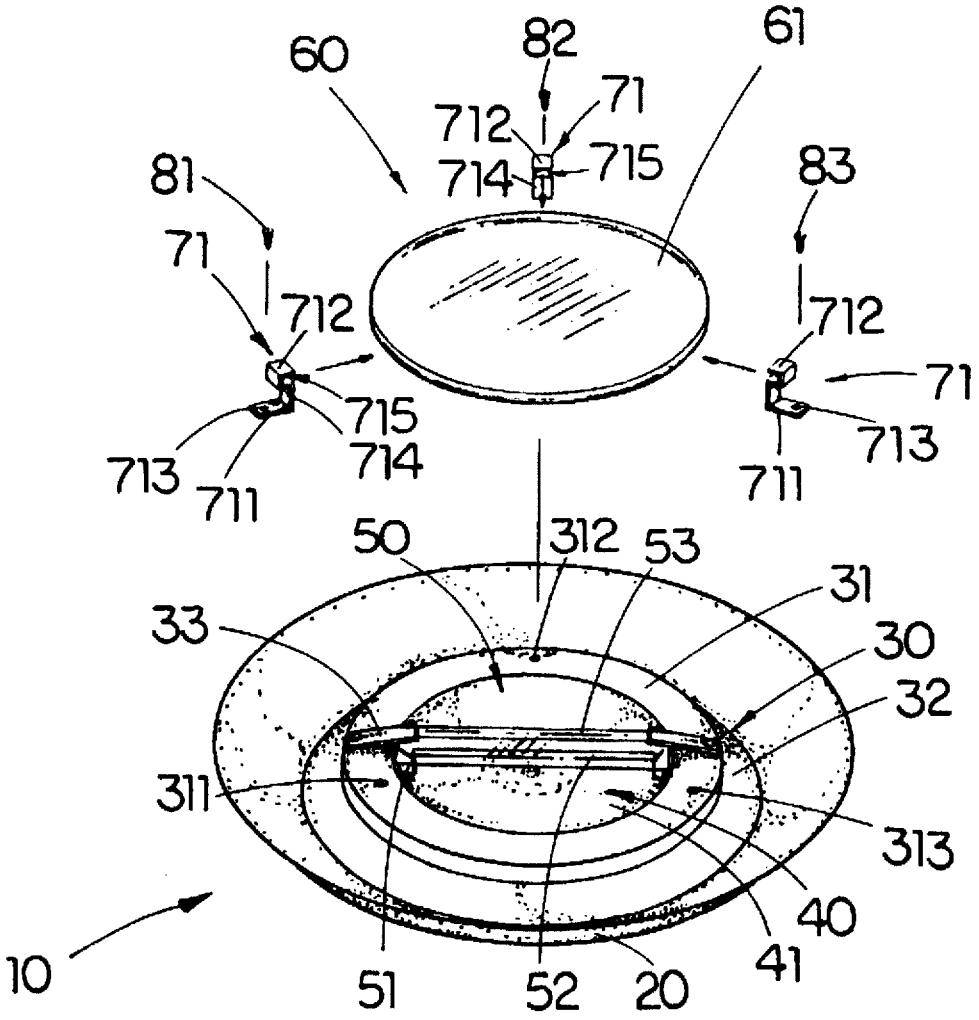
FIG. 2 is an exploded perspective view of the lamp head according to the above first embodiment of present invention.
Figure 3A:
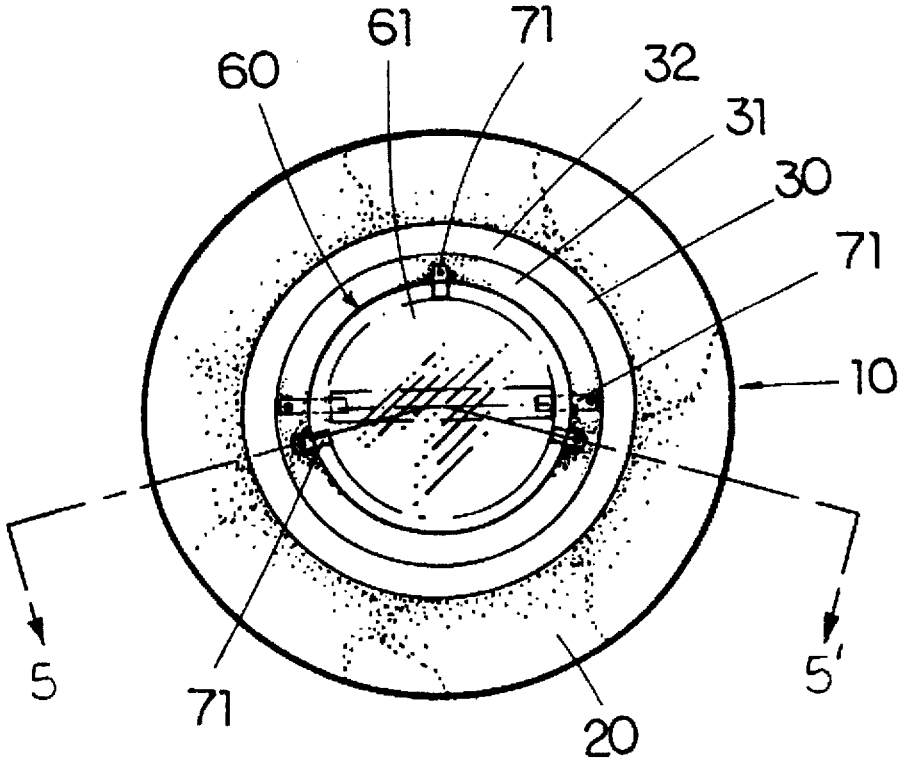
FIG. 3A is a plan view of the lamp head according to the above first embodiment of the present invention.
Figure 3B:
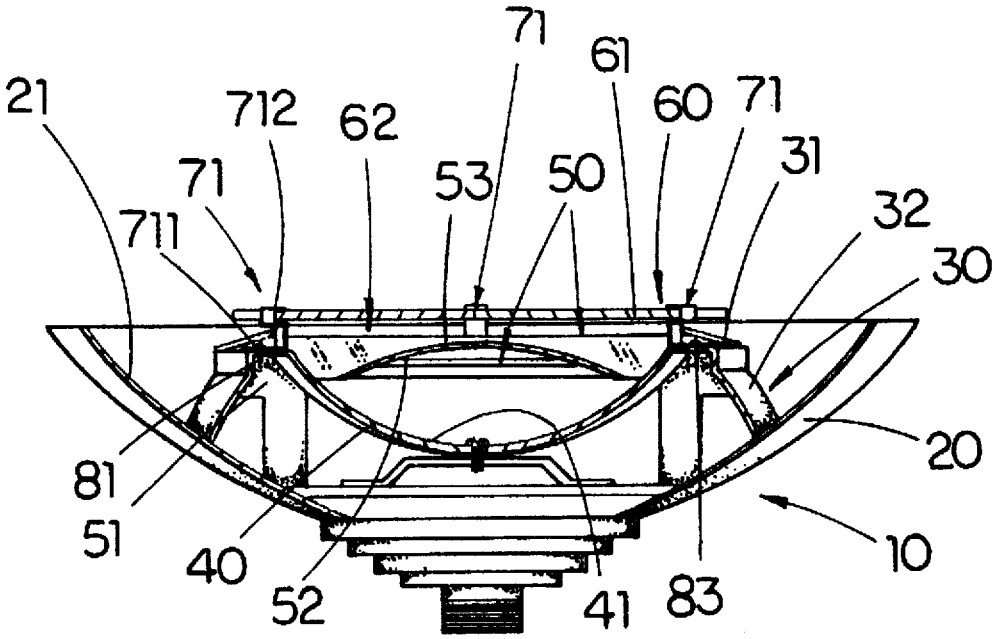
FIG. 3B is a partial sectional end view of the lamp head along the section line A–A' in FIG. 3A according to the above first embodiment of the present invention, showing how the air current within the high temperature zone flows and ventilates.

Referring to FIGS. 1 to 3, a lamp head incorporated with an anti-combustion arrangement according to a first preferred embodiment of the present invention is illustrated. The lamp head 10 generally comprises an upwardly directed dome, bowl or pan 20 and a circular reflector member 30 disposed internally of the pan 20. The reflector member 30 comprises a circular planar lip 31 and a circular supporting wall 32 extended downwardly to integrally affix on an inner surface 21 of the pan 20.

As shown in FIGS. 2 and 3, the lamp head 10 further comprises a concave reflecting disc 40 supported by the planar lip 31 of the reflector member 30. The planar lip 31 includes a holding means 51 for electrically receiving a high voltage halogen light source 52 which is a halogen bulb facing upward according to the present embodiment. The reflecting disc 40 has an inner concave reflecting surface 41 for reflecting the light beams emitted from the halogen light source 52 upwardly. The planar lip 31 further provides a pair of holding joints 33 for supporting an arc-shaped shielding lens 53 which is adapted to closely cover the halogen light source 52.

Generally, the common lamp head 10 as described above is affixed to a top end of a stem 11 which is rigidly affixed to a weighty base 12, as shown in FIG. 3, to assemble as a stand-alone electric lamp. The stand-alone electric lamp can be a floor lamp when an elongated stem 11 is used to rise the lamp head 10 up vertically above and over our head level. The stand-alone electric lamp will be a table lamp if a short stem is used.

It is well known that the halogen light source 52 of such lamp head 10 of the standalone electric lamp generates a great amount of heat so that the cavity defined between the concave reflecting surface 41 of the reflecting disc 40 and the halogen light source 52 has a relatively high temperature. The halogen light source 52 and the concave reflecting surface 41 become burning hot. Therefore, a high temperature burning zone 50 is formed, as shown in FIG. 2, which includes the space above the concave reflecting surface 41 and around the halogen light source 52. In fact, it is a hazardous situation that, if insects or any other combustible objects is placed or fallen on this high temperature burning zone accidentally, such combustible objects will be burnt by the heat of the high temperature burning zone 50 and may cause hazardous fire.

In order to prevent heat builds up in the high temperature burning zone 50, the lamp head 10 of the present invention is incorporated with an anti-combustion arrangement 60. The anti-combustion arrangement 60 comprises a transparent protective shelter 61 having a size at least equal to the length of the halogen light source 52 and a supporting means 70 for supporting the protective shelter 61 at a predetermined height right above the halogen light source 52 to define an air ventilation clearance 62 between the protective shelter 61 and the halogen light source 52.

In accordance with the first embodiment of the present invention, the transparent protective shelter 61 comprises a thickened transparent heat-resistant circular planar glass having a diameter equal to or larger than the length of the halogen light source 52 or the diameter of the reflecting disc 40 in order to cover both the halogen light source 52 and the reflecting disc 40. The supporting means 70 comprises at least a supporter 71 firmly secured to the reflector member 30 for rigidly and firmly holding the protective shelter 61 right above the concave reflecting disc 52, the halogen light source 40 and the shielding lens 53 so as to entirely cover the high temperature burning zone 50.

According to the first embodiment, there are three identical S-shaped supporters 71 affixed angularly and spacedly on the planar lip 31 of the reflector member 30 to evenly hold and support the protective shelter 61 in position. Each supporter 71 has a base member 711 and a holder member 712. The planar lip 31 has three screw holes 311, 312, 313 formed angularly and spacedly thereon. The three base members 711, each having a connecting hole 713, are firmly screwed onto the three screw holes 311,312, 313 of the planar lip 31 of the reflector member 30 by three screws 81, 82, 83 (as shown in FIG. 2) through the three connecting holes 713. Each base member 711 further has a vertical neck 714 extending upwardly from the base member 711 for a predetermined height to integrally connect with the respective holder member 712. Each holder member 712 is in C-shaped and defines a receiving slot 715 facing to the center of the concave reflecting surface 41 of the reflecting disc 40 for engaging with a periphery edge of the protective shelter 61. Therefore, by screwing the three supporters 71 onto the planar lip 31 of the reflector member 30, the protective shelter can thus be supported on top of the halogen light source 52 and the reflecting disc 40. The upwardly extending necks 714 of the three supporters 71 raise the protective shelter 61, which is firmly held by the three holder members 712 in position, for a predetermined height from the planar lip 31 to define the air ventilation clearance 62 between the protective shelter 61 and the shielding lens 53 of the halogen light source 52.

To replace a new halogen light source 52, the user simply needs to unscrew one of the three screws 81, 82, 83 and removes one of the supporters 71. Then, the user may easily slide the protective shelter 61 out of the two receiving slots 715 of the other two affixed supporters 71. After the halogen bulb replacement, the user can slide back the protective shelter 61 to the two receiving slots 715 of the two affixed supporters 71, and then mount the holder member 712 of the detached supporters 71 on the protective shelter 61 again, and then re-screw the detached supporters 71 onto the planar lip 31.

As shown in FIG. 3, since the protective shelter 61 is installed to overlap and cover the whole high temperature burning zone near the halogen light source 52 and the concave reflecting surface 41 of the lamp head 10, the high temperature burning zone 50 is sheltered by the protective shelter 61 to prohibit the intrusion of any object from entering the high temperature burning zone 50 of the lamp head 10. Moreover, the protective shelter 61 guides and spreads the heat wave generated by the halogen light source 52 to flow aside, the temperature within the high temperature burning zone 50 is decreased by spreading the heat wave and providing air ventilation and circulation through the air ventilation clearance 62. Also, due to the heat insulation effect provided by the thickened glass protective shelter 61, the temperature of the top surface of the protective shelter 61 is greatly reduced to a non-combustible temperature. Another unexpected result can also be achieved by the anti-combustion arrangement 60 of the present invention. Generally, the conventional halogen bulb merely provides white light. However, according to the present invention, since the protective shelter 61 is installed to entirely overlap and cover the halogen light source 52, a colored transparent glass can be used as the protective shelter 61 so that the lighting of the halogen light source 52 can thus be filtered to colored lighting. The user may replace different protective shelters 61 of different colors to achieve different colored lighting whenever the user desires.

Figure 4:
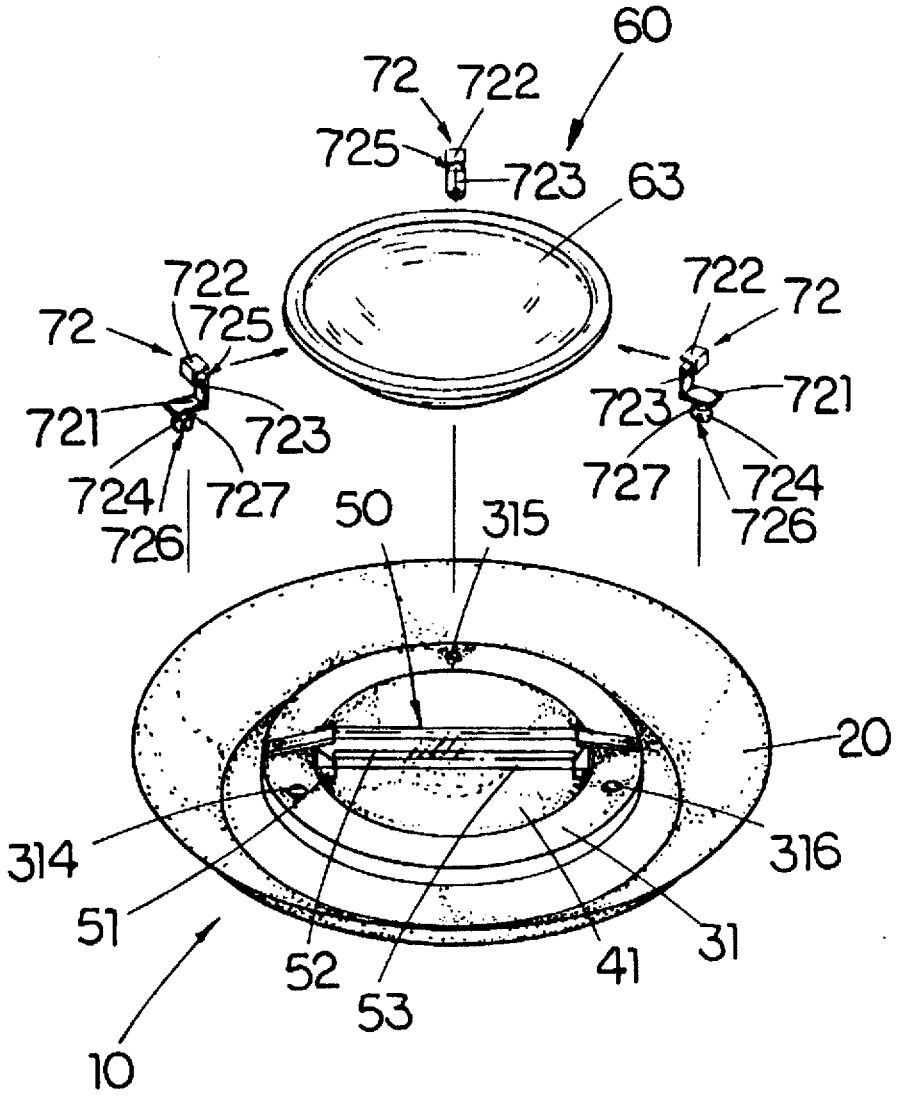
FIG. 4 is an exploded perspective view of a lamp head incorporated with an anti-combustion arrangement according to a second preferred embodiment of the present invention.
Figure 5:
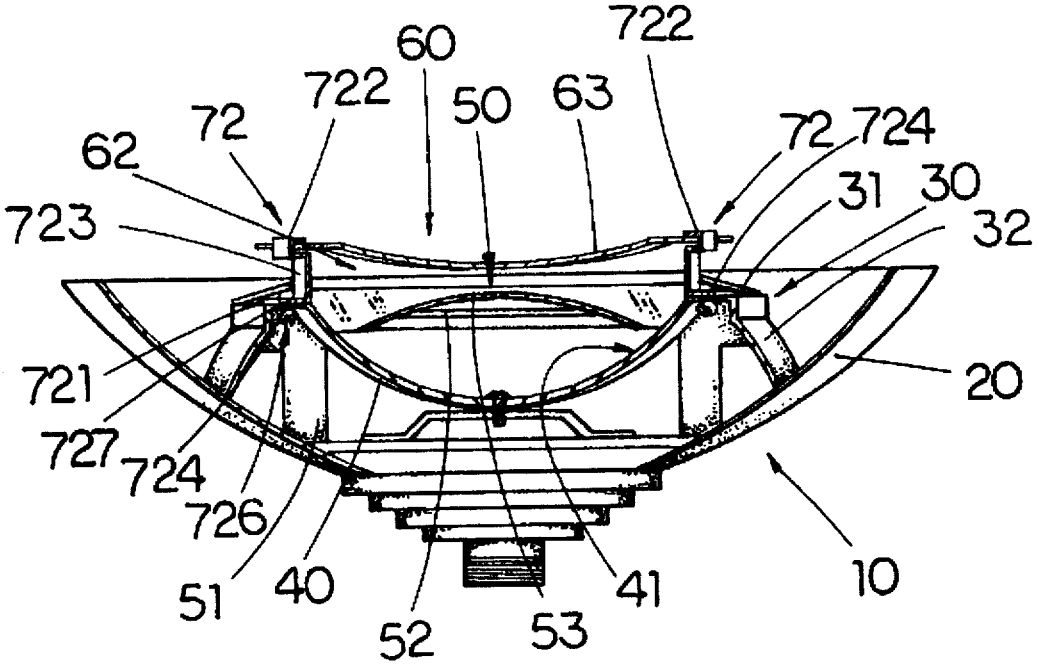
FIG. 5 is a partial sectional end view of the lamp head according to the above second preferred embodiment of the present invention, illustrating the detachably mounting of the supporters for holding a concave protective shelter.

Referring to FIGS. 4 and 5, a second preferred embodiment of the present invention is illustrated, in which a second embodied anti-combustion arrangement 60 including an alternative mode of the protective shelter 63 and a modification of the three supporters 72 is utilized in the lamp head 10 as disclosed in the above first embodiment. The protective shelter 63 in this second embodiment is made of a thickened transparent concave glass which also has a diameter successfully covering and protecting the high temperature burning zone 50 from the intrusion of any combustible matters. Each of the supporters 72 comprises a base member 721, a C-shaped holder member 722 and a vertical neck 723 extending from the base member 721 upwardly to connect with the holder member 722 so as to raise the holder member 722 for a predetermined height. The planar lip 31 of the reflector member 30 has three securing holes 314, 315, 316.

The base member 721 of each supporter 72 has a connecting stem 727 extended downwardly to integrally connect with an enlarged holding head 724 which is adapted for inserting through the respective securing hole 314, 315, 316 of the planar lip 31. Therefore, the three supporters 72 can be rotatably, angularly and spacedly held on the planar lip 31. Each holder member 722 forms a receiving slot 725, having a width equal to the thickness of the protective shelter 63, for receiving a periphery edge of the protective shelter 63. Therefore, the protective shelter 63 can be firmly supported right above the concave reflecting surface 41, the halogen light source 52 and the shielding lens 53 by the three supporters 72. Accordingly, the high temperature burning zone 50 is overlapped and covered by the protective shelter 63, wherein the air ventilation clearance 62 is also defined between the concave protective shelter 63 and the shielding lens 53 for heat wave spreading. Furthermore, each of the holding heads 724 has a compressive slot 726 formed thereon for facilitating the insertion of the holding heads 724 through the securing holes 314, 315, 316 and enabling the holding heads 724 to be directly pulled out through the securing holes 314, 315, 316 for replacing the halogen light source 52 or the protective shelter 63 of different color. The user may also detach the concave protective shelter 63 from the lamp head 10 by taming the holder members 722 for 180 degree.

Figure 6:
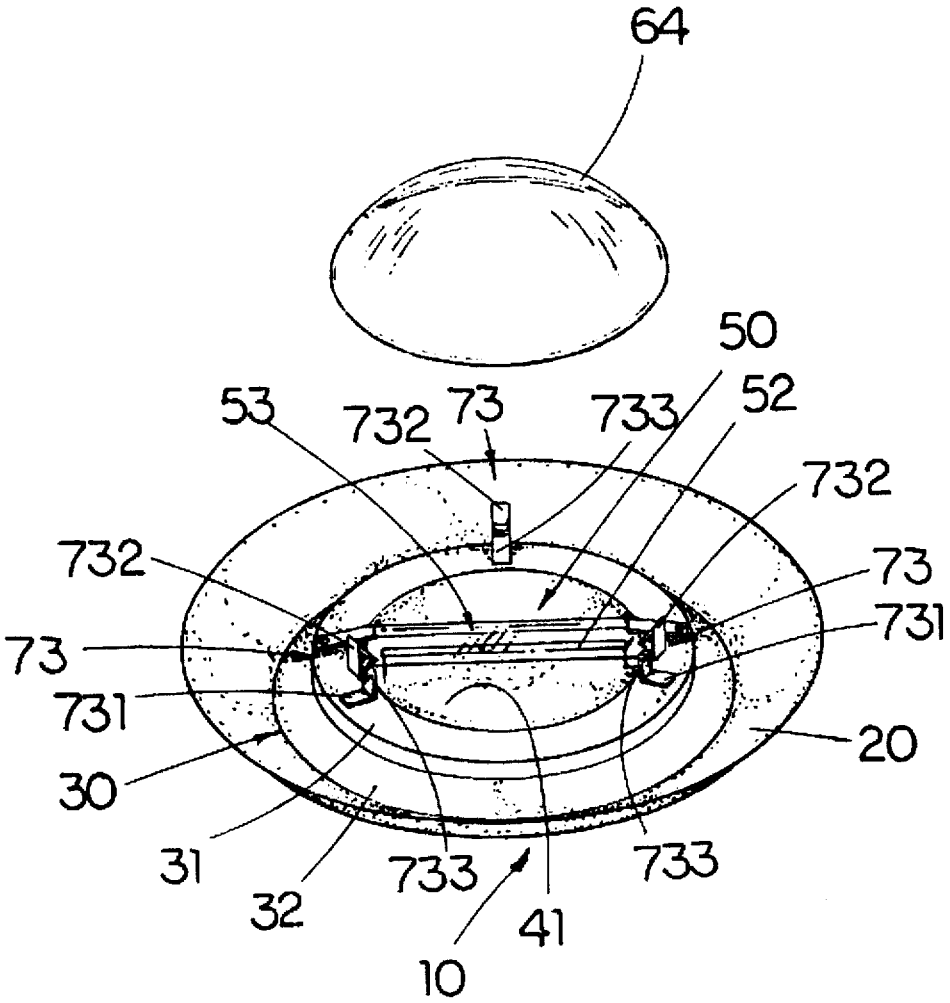
FIG. 6 is an exploded perspective view of a lamp head incorporated with an anti-combustion arrangement according to a third preferred embodiment of the present invention.
Figure 7:
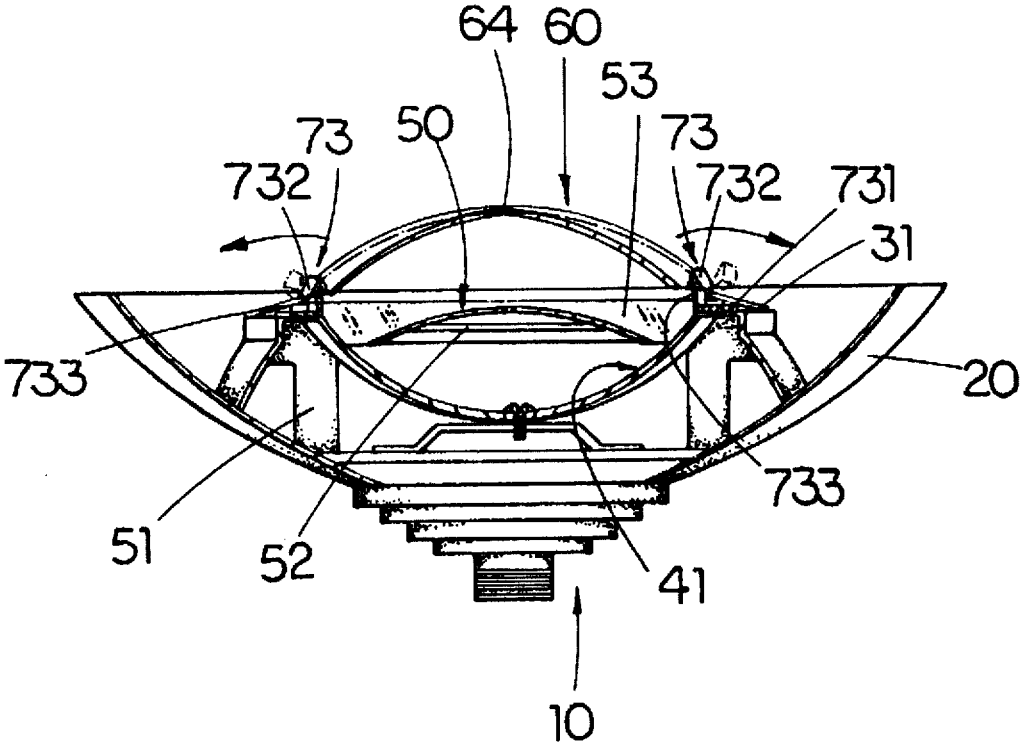
FIG. 7 is a partial sectional end view of the lamp head according to the above third preferred embodiment of the present invention, illustrating the welded mounting of the supporters for holding a convex protective shelter.

Referring to FIGS. 6 and 7, a third preferred embodiment of the present invention is illustrated, which is an alternative mode of the above second embodiment. In accordance to the third preferred embodiment of the present invention, the protective shelter 64 is a thickened transparent convex glass mounted to protect the high temperature burning zone 50. Each of the supporters 73 comprises a base member 731, a clamp-like holder member 732 and a vertical neck 733 extending from the base member 731 upwardly to connect with the holder member 732 so as to raise the holder member 732 for a predetermined height. The three base member 731 are firmly welded on the planar lip 31 of the reflector member 30. The three clamp-like holder members 732 are clipped on the periphery edge of the convex protective shelter 64 so as to support the convex protective shelter 64 right above the high temperature burning zone 50. When the user would like to replace the halogen light source 52 or another protective shelter 64 of different color or shape, the user can simply push the holder members 732 outwardly (illustrating by the dotted-line in FIG. 7) for detaching the protective shelter 64 from the lamp head 10.

What is claimed is:

1. A lamp head, comprising an upwardly directed pan and a reflector member disposed internally of said pan, in which said reflector member comprises a planar lip for supporting a reflecting disc and a holding means for electrically receiving a halogen light source, said reflecting disc having an inner concave reflecting surface positioned below said halogen light source, a shielding lens being mounted on said planar lip for closely covering said halogen light source, wherein a high temperature burning zone is formed above said concave reflecting surface and around said halogen light source; and an anti-combustion arrangement which comprises a transparent protective shelter and a supporting means, said protective shelter having a size adapted to entirely cover said halogen light source, said supporting means being disposed on said reflector member for supporting said protective shelter at a predetermined height from said planar lip and right above said halogen light source to cover said high temperature burning zone and to define an air ventilation clearance between said protective shelter and said halogen light source.

2. A lamp head as recited in claim 1 in which said supporting means comprises at least a supporter firmly secured on said planar lip of said reflector member for rigidly and firmly holding said protective shelter right above said concave reflecting disc, said halogen light source and said shielding lens so as to entirely cover said high temperature burning zone.

3. A lamp head as recited in claim 2 in which said supporter has a base member for secured on said planar lip of said reflector member and a holder member for firmly holding and supporting said protective shelter in position.

4. A lamp head as recited in claim 1 in which said supporting means comprises three identical supporters affixed angularly and spacedly on said planar lip of said reflector member to evenly hold and support said protective shelter in position, wherein each supporter has a base member and a holder member, said three supporters being angularly and spacedly affixed on said planar lip by firmly and rigidly securing said three base members on to said planar lip, so that said protective shelter is firmly held in position by said three holder members of said three supporters.

5. A lamp head as recited in claim 4 in which said planar lip has three screw holes formed angularly and spacedly thereon, each of said three base members having a connecting hole, wherein said three base members are firmly screwed to said three screw hole of said planar lip of said reflector member by three screws through said three connecting holes, each of said base members further having a vertical neck extending upwardly from said base member for a predetermined height to integrally connect with said respective holder member, each of said holder members having a receiving slot facing to a center of said concave reflecting surface for engaging with a periphery edge of said protective shelter, so that by screwing said three supporters onto said planar lip of said reflector member, said protective shelter is supported on top of said halogen light source and said concave reflecting surface, and that said upwardly extending necks of said three supporters raise said protective shelter for a predetermined height from said planar lip to define said air ventilation clearance between said protective shelter and said shielding lens of said halogen light source.

6. A lamp head as recited in claim 4 in which each of said supporters further comprises a vertical neck extending from said base member upwardly to connect with said holder member so as to raise said holder member for a predetermined height, said planar lip of said reflector member having three securing holes, said base member of each supporter having a connecting stem extended downwardly to integrally connect with an enlarged holding head which is adapted for inserting through said respective securing hole of said planar lip, so that said three supporters are rotatably, angularly and spacedly held on said planar lip, each holder member forming a receiving slot, having a width at least equal to a thickness of said protective shelter, for receiving a periphery edge of said protective shelter, so that said protective shelter is supported right above said concave reflecting surface, said halogen light source and said shielding lens by said three supporters for overlapping and covering said high temperature burning zone.

7. A lamp head as recited in claim 6 in which each of said holding heads has a compressive slot formed thereon for facilitating the insertion of said holding heads through said securing holes and enabling said holding heads to be pulled out through said securing holes for replacing said halogen light source.

8. A lamp head as recited in claim 4 in which each of said supporters further comprises a vertical neck extending from said base member upwardly to connect with said holder member so as to raise said holder member for a predetermined height, wherein said three supporters are firmly welded onto said planar lip of said reflector member, and that said three holder members are clipped on a periphery edge of said protective shelter, so that said protective shelter is supported right above said concave reflecting surface, said halogen light source and said shielding lens so as to overlapping and covering said high temperature burning zone.

9. A lamp head as recited in claim 1 in which said transparent protective shelter is made of a thickened heat-resistant circular planar glass having a diameter at least equal to said length of said halogen light source.

10. A lamp head as recited in claim 3 in which said transparent protective shelter is made of a thickened heat-resistant circular planar glass having a diameter at least equal to said length of said halogen light source.

11. A lamp head as recited in claim 5 in which said transparent protective shelter is made of a thickened heat-resistant circular planar glass having a diameter at least equal to said length of said halogen light source.

12. A lamp head as recited in claim 6 in which said transparent protective shelter is made of a thickened heat-resistant circular planar glass having a diameter at least equal to said length of said halogen light source.

13. A lamp head as recited in claim 8 in which said transparent protective shelter is made of a thickened heat-resistant circular planar glass having a diameter at least equal to said length of said halogen light source.

14. A lamp head as recited in claim 1 in which said protective shelter is made of a thickened transparent curved glass.

15. A lamp head as recited in claim 3 in which said protective shelter is made of a thickened transparent curved glass.

16. A lamp head as recited in claim 5 in which said protective shelter is made of a thickened transparent curved glass.

17. A lamp head as recited in claim 6 in which said protective shelter is made of a thickened transparent curved glass.

18. A lamp head as recited in claim 8 in which said protective shelter is made of a thickened transparent curved glass.

19. A lamp head as recited in claim 1 in which said protective shelter is a colored protective shelter.

20. A lamp head as recited in claim 4 in which said protective shelter is a colored protective shelter.

* * * * *